US009079286B1

(12) United States Patent
DeCamillis

(10) Patent No.: US 9,079,286 B1
(45) Date of Patent: Jul. 14, 2015

(54) PNEUMATIC ACTUATOR FOR IMPACT ENGRAVING TOOL

(76) Inventor: Christian DeCamillis, Traverse City, MI (US)

( * ) Notice: Subject to any disclaimer, the term of this patent is extended or adjusted under 35 U.S.C. 154(b) by 663 days.

(21) Appl. No.: 13/326,693

(22) Filed: Dec. 15, 2011

(51) Int. Cl.

| | |
|---|---|
| ***B24B 23/02*** | (2006.01) |
| ***B24B 23/04*** | (2006.01) |
| ***B25D 9/14*** | (2006.01) |
| ***B25D 9/00*** | (2006.01) |

(52) U.S. Cl.
CPC .. *B24B 23/02* (2013.01); *B25D 9/14* (2013.01)

(58) Field of Classification Search
CPC ..... B23D 51/01; B23D 47/12; B23D 51/16; B23Q 11/0071; B23Q 11/0046; B23Q 11/04; B23Q 3/12; B24B 23/02; B24B 23/04; B24B 41/007; B24B 47/26
USPC ..... 173/200
See application file for complete search history.

(56) References Cited

U.S. PATENT DOCUMENTS

| | | | | |
|---|---|---|---|---|
| 4,030,556 | A | 6/1977 | Phillips | |
| 4,694,912 | A | 9/1987 | Glaser | |
| 4,903,784 | A * | 2/1990 | Glaser | 173/200 |
| 5,203,417 | A | 4/1993 | Glaser | |
| 5,449,044 | A | 9/1995 | Phillips | |
| 5,515,930 | A * | 5/1996 | Glaser | 173/115 |
| 5,803,183 | A | 9/1998 | Phillips | |
| 6,085,850 | A | 7/2000 | Phillips | |
| 6,095,256 | A | 8/2000 | Lindsay | |
| 6,488,102 | B2 | 12/2002 | Lindsay | |
| 6,508,315 | B1 | 1/2003 | Lindsay | |
| 6,530,435 | B1 | 3/2003 | Lindsay | |
| 6,691,798 | B1 | 2/2004 | Lindsay | |
| 7,413,027 | B2 | 8/2008 | Glaser et al. | |
| 7,762,347 | B2 | 7/2010 | Glaser et al. | |
| 7,775,295 | B1 | 8/2010 | Glaser et al. | |
| 2010/0031787 | A1 * | 2/2010 | Hu | 81/477 |

* cited by examiner

*Primary Examiner* — Thanh Truong
*Assistant Examiner* — Praachi M Pathak
(74) *Attorney, Agent, or Firm* — Northern Michigan Patent Law, PLC

(57) ABSTRACT

A pneumatic actuator for use in pneumatic impact tools of the type used to engrave jewelry, and an impact tool adapted for the pneumatic actuator. The actuator includes a cylinder body with a pneumatic chamber housing a piston assembly reciprocating in response to pulses of pressurized air. The piston assembly includes a piston base and a striker pin in the pneumatic chamber, an outer end of the striker pin extending through and residing outside a forward end of the chamber. The outer end of the striker pin has an enlarged striker head of greater mass than the striker pin and/or the piston base in the chamber. A pneumatic impact tool is also disclosed, and includes a forward stylus section having a guide bore for the striker head and holding a graver assembly in spaced relationship to the striker head.

14 Claims, 3 Drawing Sheets

PNEUMATIC ACTUATOR FOR IMPACT ENGRAVING TOOL

RELATED APPLICATIONS/PRIORITY BENEFIT CLAIM

None.

FIELD

The subject matter of the present application is in the field of impact-type handheld engraving tools, often used by jewelers.

BACKGROUND

Handheld pneumatic impact tools are commonly used for engraving or removing small amounts of material from jewelry and other fine workpieces, and may even be used in orthopedic and dental surgery. Such tools typically use a pneumatically-driven piston reciprocating in a pneumatic chamber in the tool handle to transmit force to a fixed anvil in contact with a graver tip. The force transmitted to the graver tip through the anvil removes material from the workpiece. Air pressure is supplied from a separate controller through a flexible supply line. Different types of controller are commercially available.

The piston is driven intermittently by air pressure against a return spring to strike the anvil and transmit impact force to the graver in pulses. Since the graver tip is usually fixed in place, the tool moves slightly in the user's hand against the workpiece, or moves the user's hand slightly toward the workpiece.

Pistons for these pneumatic impact tools usually have a larger diameter rear base and a reduced diameter forward striker pin riding inside the return spring. The piston is contained in a pneumatic chamber and the tip of the striker pin strikes an end of the pneumatic chamber, which functions as an anvil.

In my experience, prior pneumatic impact engraving tools used by jewelers tend lack sufficient striking force at slow speeds, possibly due to their relatively fast oscillation rate and light strikers.

BRIEF SUMMARY

I have invented a pneumatic piston actuator for a pneumatic impact tool, especially useful for engraving jewelry, firearms, knives and other fine workpieces, but possibly having other uses as well. My piston actuator is able to pulse at a relatively slow rate, with increased striking force per pulse, and gives an engraver more control.

The actuator has a pneumatic cylinder body comprising a pneumatic chamber with a piston mounted to reciprocate against a return spring means. The piston has a shorter, larger diameter rear base riding in and approximating the diameter of the pneumatic chamber, and a longer, smaller diameter striker pin extending forwardly from the piston base. The striker pin has an outer end extending through the forward end of the pneumatic cylinder body, terminating outside the pneumatic chamber. The outer end of the striker pin supports an enlarged striker head having a diameter and mass greater than the diameter and mass of at least the striker pin portion of the piston inside the pneumatic chamber. In a most preferred form, the outer end of the striker pin further includes a striker tip having a diameter smaller than the striker head and extending forwardly of the striker head. The result is a weight-forward striker that is not constrained by the dimensions of the pneumatic chamber, and that concentrates the striking force of the external head over a small area.

The spring return means may be located between the piston base and a forward end of the chamber, being compressed by the piston's forward (engraving) stroke, or it may be located behind the piston and placed in tension by the piston's forward stroke. The spring return means may take different forms.

An air inlet at the rear of the pneumatic chamber supplies the rear of the piston base with forward driving pressure, and an equalizing vent at a forward end of the chamber reduces the effect of pressure and vacuum on the operation of the spring return means throughout the stroke.

In a further form, I have invented a pneumatic impact tool using the new pneumatic actuator. The impact tool defines a non-pneumatic guide bore for the pneumatic actuator's external striker head, the guide bore terminating in a graver assembly spaced from the striker head. The striker head rides in the guide bore to directly strike the graver assembly at the forward end of its stroke.

In a further form, the graver assembly is axially adjustable in the tool body toward and away from the pneumatic cylinder and striker head. The graver assembly can be positioned to be hit by the striker head at the end of the piston's drive stroke or before the end of the drive stroke, giving a different feel and cutting action to the graver tip.

In a further form the graver assembly is rotationally adjustable in the tool body, allowing the user to customize grip and graver position relative to the air supply line connected to the tool body.

In a further form, the tool body has a removable graver-holding front section, providing access to the striker head. In a further form, the striker head is removably and/or adjustably attached to the outer end of the striker pin.

In a further form, the graver assembly includes a slotted sleeve secured to the tool body and a graver tip secured to the slotted sleeve with a spring-loaded ball detent. The ball detent allows the graver tip limited motion relative to the tool when struck by the piston assembly. In a further form, the graver assembly is axially adjustable with an external threaded collar engaging mating threads on the sleeve.

"Cylinder" is used herein to include any cross-sectional shape for the actuator body, and/or for the pneumatic chamber and the piston base riding therein.

These and other features and advantages of the invention will become apparent from the detailed description below, in light of the accompanying drawings.

DETAILED DESCRIPTION

Figure 1:
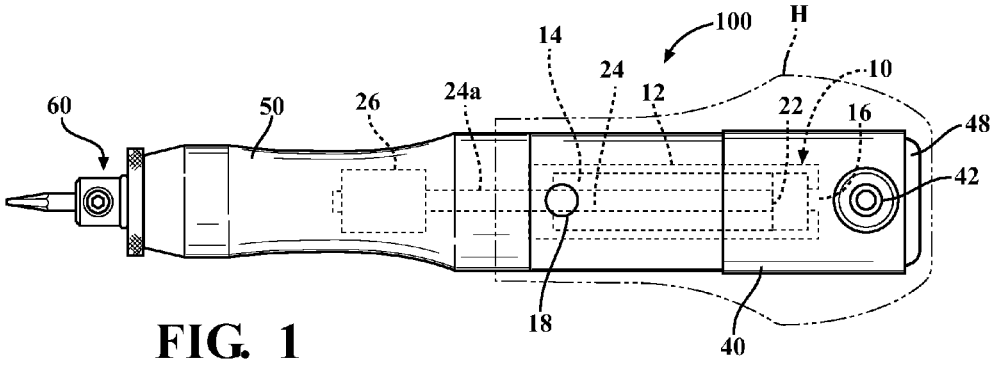
FIG. 1 is a side elevation view of a pneumatic impact tool using a pneumatic actuator according to the invention, with the pneumatic actuator shown in broken lines (phantom).
Figure 2:
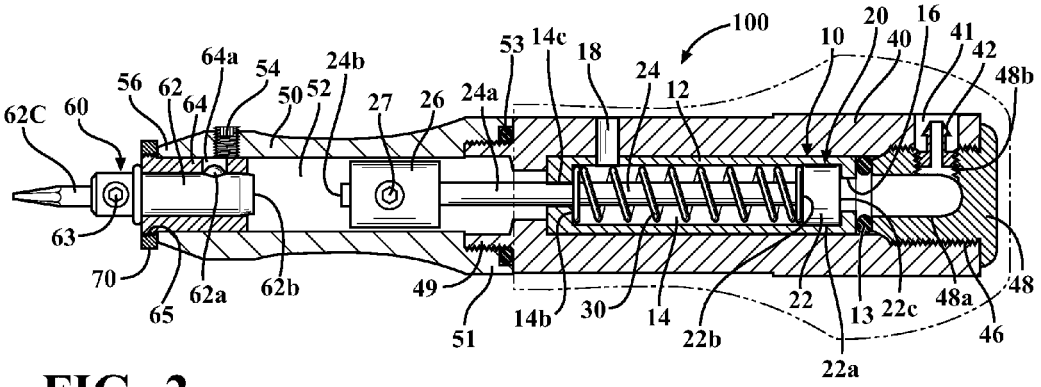
FIG. 2 is a side elevation view, partially sectioned, of the pneumatic impact tool incorporating the pneumatic actuator of FIG. 1, with the piston at rest.

Referring first to FIGS. 1 and 2, a pneumatic tool 100 with a pneumatic actuator 10 is shown in exemplary form in order to teach how to make and use the claimed invention. Actuator 10 has a pneumatic cylinder body 12 with an internal pneumatic chamber 14. An air supply port 16 is located at or near a rear end of chamber 14, adapted to be connected to or in communication with a pressurized air supply from a pneumatic air source. An optional handgrip H for fitting over the tool body is shown in phantom.

A piston assembly 20 is mounted for sliding, reciprocal movement in chamber 14 in response to pulses of pressurized air from port 16. Piston assembly 20 includes a rear piston base 22 located toward the rear end of chamber 14, a striker pin portion 24 extending forwardly from the piston base 22, and an external striker head 26. Piston base 22 has a shape and diameter approximating the cross-section of chamber 14 (in the illustrated example, circular), and preferably has a sliding pneumatic seal at 22*a* in contact with the inside surface of chamber 14. Striker pin 24 has a smaller diameter than base 22. A return spring 30 is trapped in chamber 14 between a forward face 22*b* of piston base 22 and front end wall 14*b* of the pneumatic chamber 14. Striker pin 24 may be formed as an integral extension of piston base 22, or may be a separately-formed piece connected to base 22.

The spring return means for the piston assembly may be located between the piston base and a forward end of the chamber, as shown, being compressed by the piston's forward (engraving) stroke. Alternately, the spring return may be located behind the piston and placed in tension by the piston's forward stroke. The spring return means may take different forms. While a single forward-mounted coil-type compression spring is shown at 30 in the illustrated example, other possible options include different types of springs, multiple spring arrays, resilient elastomer cushions, pneumatic returns (using one or more additional air lines connected for a return pulse of air or vacuum), without limitation.

Striker pin 24 passes through the forward end 14*b* of pneumatic chamber 14, for example through an opening 14*c*. Striker pin outer end 24*a* accordingly resides outside the pneumatic chamber 14 in which the piston base 22 reciprocates. Striker outer end 24*a* includes a striker head 26 having a mass and diameter greater than the main body of at least the striker pin 24 in pneumatic chamber 14, and in the preferred form greater than the mass and diameter of piston base 22.

In the illustrated example, an outer tip 24*b* of the striker pin extends forwardly of the front face of striker head 26, functioning as the primary contact surface for delivering the force of piston assembly 20 over a concentrated area (smaller than the diameter of striker head 26) to a graver tip. Alternately, the front face of striker head 26 could be provided with an integral extension having a smaller diameter than the striker head as a whole. It will be understood, however, that a protruding tip such as 24*b* could be omitted in favor of having the front face of striker head 26, either in whole or in part, impact the graver assembly. For simplicity, striker head 26 will be described as delivering the impact to the graver assembly, whether or not a protruding part of the striker pin or some other force-concentrating extension of lesser diameter is the actual point of contact.

The materials used for tool 100 and actuator 10 (other than seals) will generally be metals such as aluminum, steel and/or brass (without limitation) to withstand the pneumatic pressures involved in the tool's operation, repeated striking of impact surfaces, striker head mass, and other factors which will be recognized by those skilled in the art. However, some parts may be made from other materials such as strong polymers or composite fiber/resin type materials, without limitation.

In the illustrated example, actuator 10 is removably contained in a pneumatic receiver portion 40 of tool 100. Pneumatic receiver 40 receives and supplies air pressure to the actuator 20, and optionally functions as part of the tool handle. While a two-part actuator/receiver structure is currently preferred, it would be possible to build actuator 20 with an integrated pneumatic receiver structure. Receiver 40 holds and supports actuator body 12 in communication with an air supply line connected to rear pneumatic connector 42, which in the illustrated example is a male pneumatic connector accessible through a radial air supply port 41 in the receiver and adapted to be connected to the end of an air supply line.

In the illustrated example, port 16 in pneumatic actuator 10 functions as both inlet and outlet for pressurized air from a suitable two-way supply line. Alternately, separate inlets and outlets could be used with separate supply and exhaust lines. Port 16 may be a male or female connector or a simple opening as shown, or may take other forms depending on the air supply line used. Port 16 communicates drive air to the rear face 22*c* of piston base 22 in chamber 14, while at least one equalizing vent 18 is formed at or near a forward end of chamber 14, communicating with atmosphere.

Pneumatic actuator body 12 is inserted into receiver chamber 44 via an end opening 46, and secured in place with a threaded retainer plug 48 whose external threads mate with internal threads in opening 46. Retainer plug 48 has a hollow axial stem 48*a* communicating with a radial port 48*b* aligned with port 41 when the plug is fully inserted. Pneumatic connector 42 is installed in port 48*b* through port 41. A pneumatic seal such as O-ring 13 may be provided between plug 48 and the rear of actuator 10.

When actuator 20 is installed in receiver 40, striker pin outer end 24*a* extends from the actuator body 12. Striker head 26, which in the illustrated example includes a bore 26*a* (FIG. 4) adapted to receive striker pin outer end 24*a*, is then installed on outer end 24*a*, for example with a set screw 27 as shown. Other attachment methods are possible, for example using mating threads on outer end 24*a* and in bore 26*a*.

Tool 100 also includes a front stylus section 50 that mounts a graver assembly 60 in spaced relationship to striker head 26, and that may also function as a handle. Stylus section 50 is shown as being removably connected to receiver 40 via mating threaded sections 49 and 51, and includes a guide bore 52 in which striker head 26 can reciprocate toward and away from graver assembly 60. Stylus section 50 may also function as a handle. A lock washer or compression seal such as O-ring 53 may be provided between the mated stylus section 50 and receiver 40.

Guide bore 52 does not need to be pneumatically sealed with respect to the exterior of tool 100 or with respect to receiver 40 or actuator 20, since striker head 26 operates outside the pneumatically sealed portion of chamber 14 defined behind piston base 22. Striker head 26 accordingly functions in a portion of tool 100 that remains at a pressure essentially equal to atmosphere outside the tool. Also, "guide" is a term used more for convenience than limitation, since in the illustrated example, striker head 26 does not touch the sidewall of bore 52. Guide bore 52 accordingly need not be a cylindrical bore matching the shape of the striker head, as long as it provides a path of travel for the striker head with a consistent spacing to the graver assembly. It would also be possible to have a wiping or sliding contact between the striker head and the guide bore, but such contact would be unnecessary and is not currently preferred.

FIG. 2 shows piston assembly 20 is in a rearward or neutral position (non-striking or "at rest"), with spring means 30 in its unloaded (uncompressed) condition, piston base 22 biased toward the air supply (rear) end of pneumatic chamber 14 in actuator 20, and striker head 26 spaced at its farthest from graver assembly 60. The piston assembly 20 may start the engraving stroke from this neutral/rearward position with some types of air supply, as in the present example. Alternately, the piston assembly may start in a forward position, adjacent or in contact with the graver assembly, if the air supply is the type where air pressure is constantly supplied to the base of the piston and initially relieved to start the engraving stroke, so that the piston must first move rearwardly before being driven forward for an engraving stroke.

Figure 3:
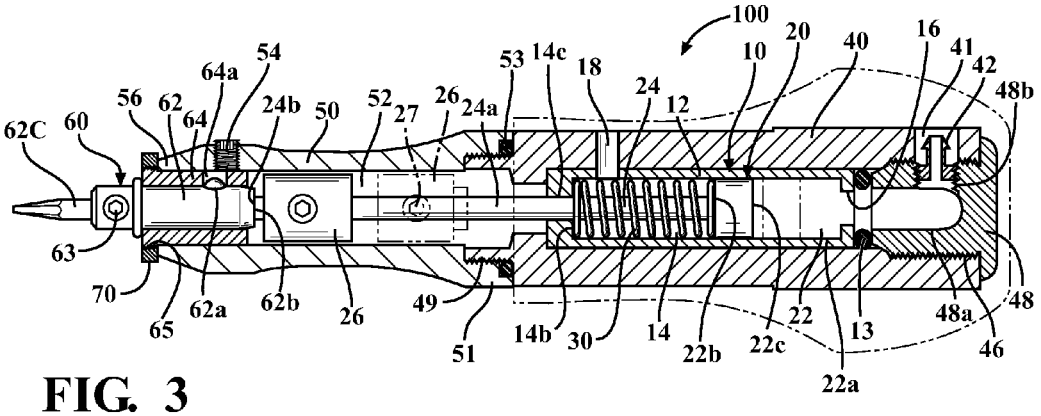
FIG. 3 is similar to FIG. 2, with the piston partway forward through a drive stroke (phantom) and fully forward (solid).

FIG. 3 shows piston assembly 20 partway and fully through a drive stroke toward graver assembly 60, driven by a pulse of air delivered from air supply line through connector 42 to pneumatic actuator 10. The pulsed air acts on the rear face 22*b* of piston base 22 to displace the piston toward the front end 14*b* of pneumatic chamber 14, compressing spring 30 in the process. At the end of the drive stroke, striker head 26 (or any protruding portion 24*b* of striker pin 24) impacts the rear of graver assembly 60. Graver assembly 60 in turn delivers the impact force to a workpiece (not shown) to remove a small amount of material from the workpiece.

At the end of the drive stroke, i.e. after striker head 26 has impacted graver assembly 60, the driving air pressure behind piston base 22 is vented to allow spring 30 to return the piston assembly to the at-rest position of FIG. 2. In the illustrated example, driving air pressure is vented via connector 42, using a two-way air supply line from an appropriate controller. Other means for venting the driving air pressure are possible, including but not limited to additional pressure-venting ports located in pneumatic actuator body 12 and communicating with atmosphere, or with an air return line, at an appropriate point in the piston stroke.

Figure 4:
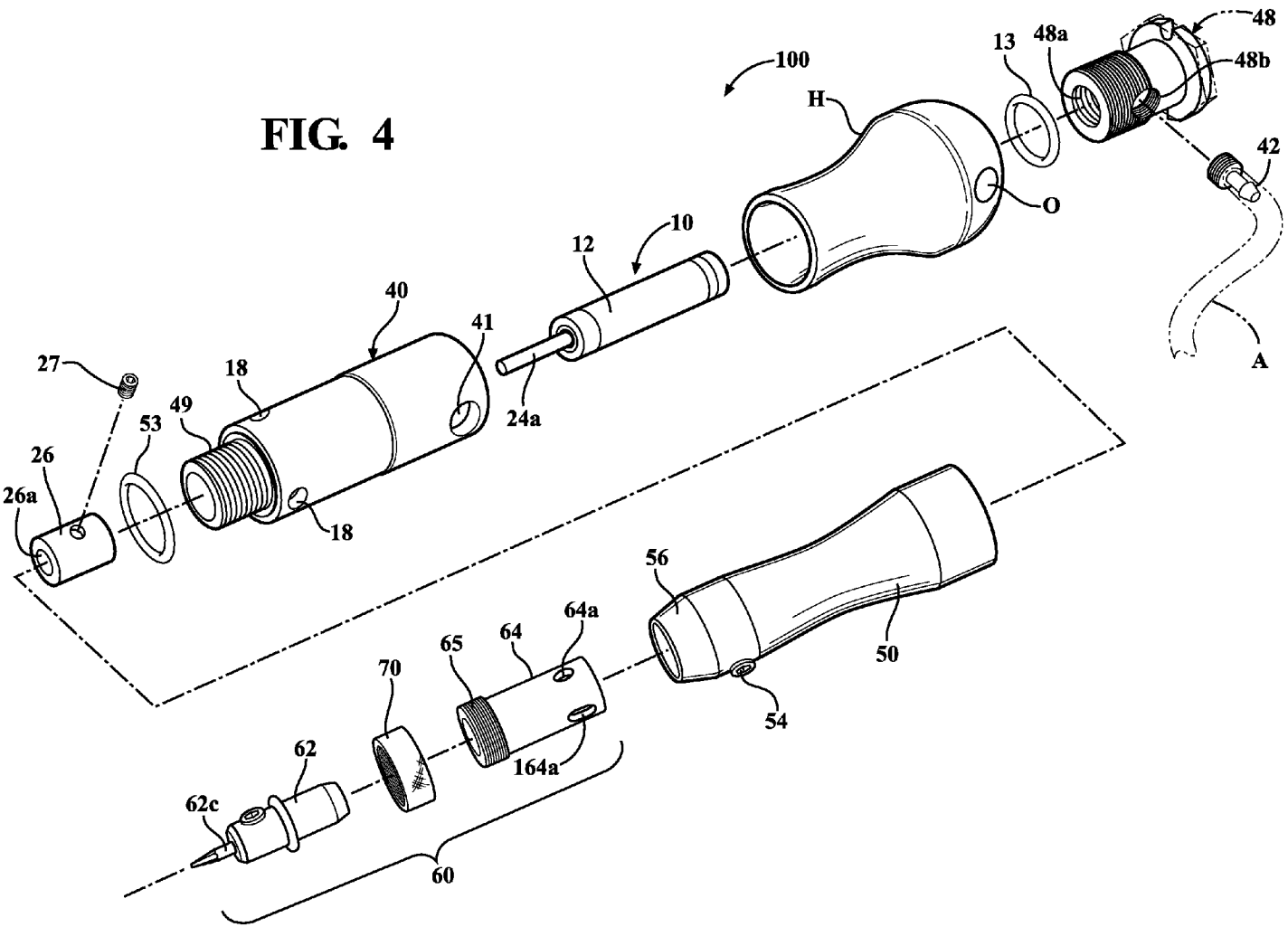
FIG. 4 is an exploded assembly view of the parts of the tool of FIG. 2.
Figure 5:
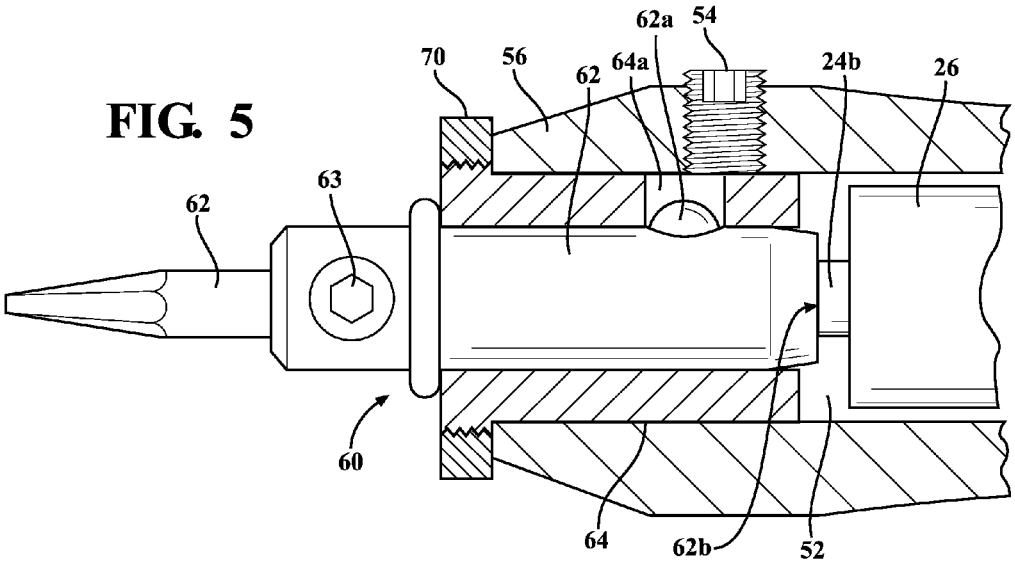
FIG. 5 is a detail of the graver assembly of the tool in FIG. 1, in a first adjusted position.
Figure 6:
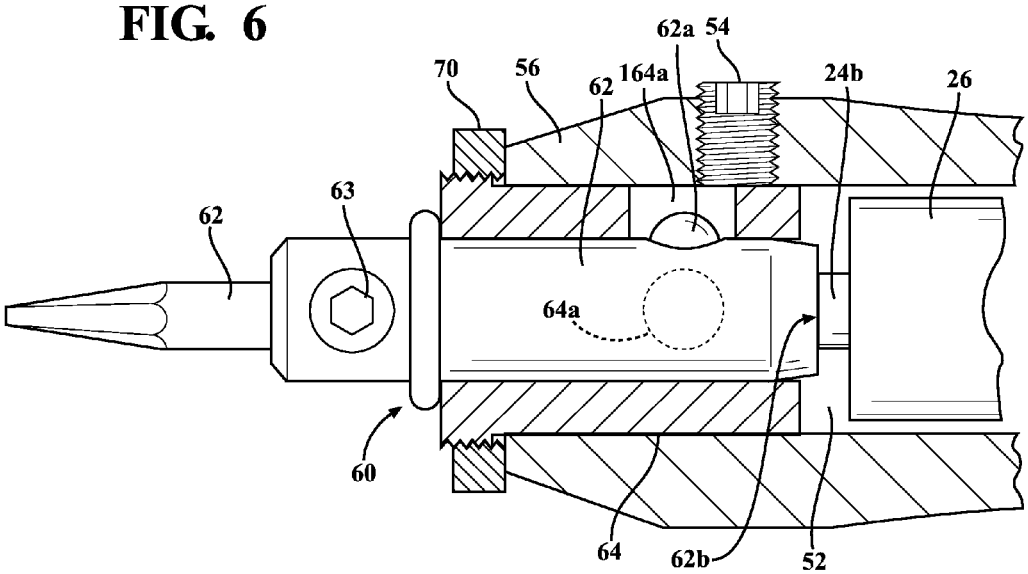
FIG. 6 is a detail of the graver assembly of FIG. 5, in a second adjusted position.

Referring now to FIGS. 4, 5, and 6, graver assembly 60 is shown adjustably mounted in the forward section of stylus section 50, more specifically in the forward end of guide bore 52. The illustrated graver assembly 60 includes a graver tip 62 removably secured in a sleeve 64, which in turn is removably and adjustably secured in stylus section 50 with a set screw 54. The axial position of graver assembly 60 in bore 52 can be adjusted toward or away from striker head 26 by loosening set screw 54, sliding graver assembly 60 forward or rearward in bore 52, and then re-tightening screw 54. In this manner the graver assembly can be positioned to receive the impact from striker head 26 at the full length of the drive stroke (when piston assembly 20 has been driven as far forward as possible by the force of spring 30, the force of the air pulse delivered to actuator 10, and/or the length of chamber 14); or, the graver assembly 60 can be positioned to receive the impact of the striker head at less than the full length of the drive stroke, adding a "push" component to the impact of the graver on the workpiece that can produce a noticeable difference in feel to a skilled jeweler. Once set screw 54 is loosened, it is possible to provide a more controlled axial adjustment of the graver assembly 60 using a threaded collar 70 as described in more detail below.

Graver tip 62 is mounted for a limited degree of movement in sleeve 64, via a resilient detent 62*a* which snaps into connection with one of one or more detent holes 64*a*, 164*a* of different size in sleeve 64 as shown in FIGS. 4 and 5. When striker head 26 impacts the rear face 62*b* of tip 62, ball detent 62*a* yields with respect to sleeve 64, allowing the tip a small amount of motion relative to the sleeve and thus relative to tool 100 depending on the size of the detent hole. In the illustrated example the detent 62*a* is a spring-loaded ball detent, but other forms of resilient detent could be used, including but not limited to flat springs and resilient elastomer materials.

The circular cross-section of bore 52 and sleeve 64 also allow graver assembly 60 to be rotationally adjusted with respect to tool 100. Rotational adjustment may be desired where the graver has a preferred working angle, or where the nature and placement of air supply line relative to the tool handle limit the user's grip. When set screw 54 is loosened, graver assembly 60 can be rotated left or right in bore 52 to a position most comfortable or convenient for the user, and then tightened in place.

Illustrated graver tip 62 includes a removable graver 62*c*, made from a hard cutting material such as carbide, secured in the graver tip with a set screw 63. Graver 62*c* may accordingly be removed for repair or replacement. It will be understood that graver 62*c* could also be an integral, non-removable portion of graver tip 62. The shape, cutting edge, and other features of graver 62*c* may vary.

A further feature of the illustrated graver assembly 60 is a thread-adjustable collar 70, removably secured to a threaded outer end 65 of graver assembly sleeve 64. Collar 70, which may have a knurled or textured surface, has a bore diameter adapted to fit over graver assembly 60 and abut the tapered forward end 56 of stylus section 50. When set screw 54 is loosened, collar 70 may be rotated against the tapered surface 56, in order to axially adjust graver assembly 64 forward or rearward. This adjustment via collar 70 is best done with two hands (one holding the graver assembly and one turning collar 70), although with practice it can be done with one hand applying pressure through collar 70 against the stylus end 56, even while engraving.

Description of Operation

In operation, the impact tool is used by connecting it to a controllable pneumatic air supply via a supply line A (FIG. 4) mating with connector 42. The tip of graver 62*c* is placed against a workpiece, and the air supply is operated to deliver pressurized air to the pneumatic actuator 10. Piston assembly 20 is moved forwardly to drive striker head 26 into graver assembly 60 (FIG. 3), delivering the impact force to the workpiece. Air pressure is removed or vented from actuator 10, and the spring 30 returns piston assembly 20 to the rest position of FIG. 2.

The pulse or oscillation rate of the piston assembly in tool 100 can be controlled by the user via the air supply to achieve the desired rate of material removal from the workpiece. Pressure can also be varied to change the force per impact.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention should accordingly be construed by what the above disclosure teaches and suggests to those skilled in the art, and by any claims that the above disclosure supports in this application or in any other application claiming priority to this application.

What is claimed:

1. A pneumatic impact tool comprising a pneumatic actuator including a pneumatic cylinder comprising a pneumatic chamber including an air supply inlet, and a piston assembly including a piston base movably mounted in the pneumatic chamber to be driven forward from a home position in the pneumatic chamber to an impact position in the pneumatic chamber in response to pressure delivered via the air supply inlet, the piston assembly further including a striker head operatively connected to and spaced from the piston base and located forward of and outside the pneumatic chamber, the pneumatic impact tool further comprising a non-pneumatic guide bore containing the striker head, the non-pneumatic guide bore located forward of the pneumatic chamber and pneumatically separate from the pneumatic chamber such that the non-pneumatic guide bore remains at a pressure essentially equal to atmosphere outside the pneumatic impact tool, the non-pneumatic guide bore terminating in a graver assembly, the striker head movably positioned in the non-pneumatic guide bore and movable with the piston base toward and away from the graver assembly sufficient to strike the graver assembly at the forward end of a drive stroke, wherein:

the piston base has a first diameter and rides in and approximates the diameter of the pneumatic chamber, and a striker pin having a second diameter smaller than the first diameter extends forwardly from the piston base through a forward end of the pneumatic cylinder body and includes an outer end residing outside the pneumatic chamber in the non-pneumatic guide bore, the striker head secured to the outer end of the striker pin in the non-pneumatic guide bore, the striker head having a diameter and mass greater than the diameter and mass of the striker pin and/or a mass greater than the mass of the piston base inside the pneumatic chamber; and, a spring return means in the pneumatic chamber is in operative engagement with the piston base for returning the piston assembly from the impact position to the home position.

2. The pneumatic impact tool of claim 1, wherein a forward face of the striker head comprises a striker tip extending forwardly of the striker head and having a surface area smaller than a surface area of the forward face of the striker head.

3. The pneumatic impact tool of claim 2, wherein the striker tip comprises a portion of the striker pin extending through the striker head.

4. The pneumatic impact tool of claim 1, wherein the air supply inlet is in communication with a rear end of the pneumatic chamber and a rear face of the piston base.

5. The pneumatic impact tool of claim 4, wherein the cylinder body comprises an equalizing vent in communication with a forward end of the pneumatic chamber and a forward face of the piston base.

6. The pneumatic impact tool of claim 1, wherein the graver assembly is axially adjustable in the tool body toward and away from the pneumatic actuator and striker head.

7. The pneumatic impact tool of claim 1, wherein the graver assembly is rotationally adjustable in the tool body.

8. The pneumatic impact tool of claim 1, wherein the pneumatic impact tool further comprises a tool body having a rear receiver portion and a forward stylus portion removably assembled to the receiver portion, the receiver portion mounting the pneumatic actuator body and the stylus portion defining the non-pneumatic guide bore and mounting the graver assembly.

9. The pneumatic impact tool of claim 1, further including a thread-adjustable collar removably secured to a threaded outer end of the graver assembly and adapted to rotationally abut a front end of the pneumatic impact tool.

10. The pneumatic impact tool of claim 1, wherein the graver assembly further comprises a graver tip including a graver, and a sleeve removably holding the graver tip and removably secured to the pneumatic impact tool.

11. The pneumatic impact tool of claim 10, wherein the graver tip includes a rear base extending from the sleeve into the guide bore and positioned to be struck directly by the striker head.

12. The pneumatic impact tool of claim 10, wherein the graver tip includes a resilient detent and the sleeve includes a detent hole for receiving the detent.

13. The pneumatic impact tool of claim 12, wherein the sleeve includes a plurality of detent holes of different size for receiving the detent.

14. The pneumatic impact tool of claim 1, wherein the striker head is spaced from the spring return means by the striker pin.

* * * * *